United States Patent [19]

Willemsz

[11] Patent Number: 4,626,137

[45] Date of Patent: Dec. 2, 1986

[54] SUBMERGED MULTI-PURPOSE FACILITY

[75] Inventor: John R. Willemsz, Walnut, Calif.

[73] Assignees: Zainuddin M. Banatwala; Fred E. Dorst, both of Houston, Tex. ; part interest to each

[21] Appl. No.: 723,735

[22] Filed: Apr. 16, 1985

[51] Int. Cl.[4] ..... E02D 21/00; B63B 35/44

[52] U.S. Cl. ..... 405/224; 114/256; 114/264; 405/195; 405/204

[58] Field of Search ..... 405/195, 203–208, 405/185–194, 224; 114/264, 265, 256

[56] References Cited

U.S. PATENT DOCUMENTS

| | | | |
|---|---|---|---|
| 3,154,039 | 10/1964 | Knapp | 114/265 |
| 3,360,810 | 1/1968 | Busking | 114/256 X |
| 3,466,880 | 9/1969 | Elliott | 405/190 |
| 3,572,041 | 3/1971 | Graaf | 405/205 |
| 4,170,954 | 10/1979 | Rinalda | 405/206 |

*Primary Examiner*—Dennis L. Taylor

*Attorney, Agent, or Firm*—Vaden, Eickenroht, Thompson & Boulware

[57] ABSTRACT

A submerged multi-purpose facility is optimally located with respect to lateral forces and hydrostatic forces. Lateral force readings are first observed for the geographic location under consideration at a plurality of depths. From these readings, a lateral force curve is developed which is exponential in shape. The mid-range of this curve and just below the mid-range are the depths where the facility is ideally to be located. The facility can then be structured with respect to wall strength to withstand the hydrostatic forces at the depth location determined by the above technique.

7 Claims, 6 Drawing Figures

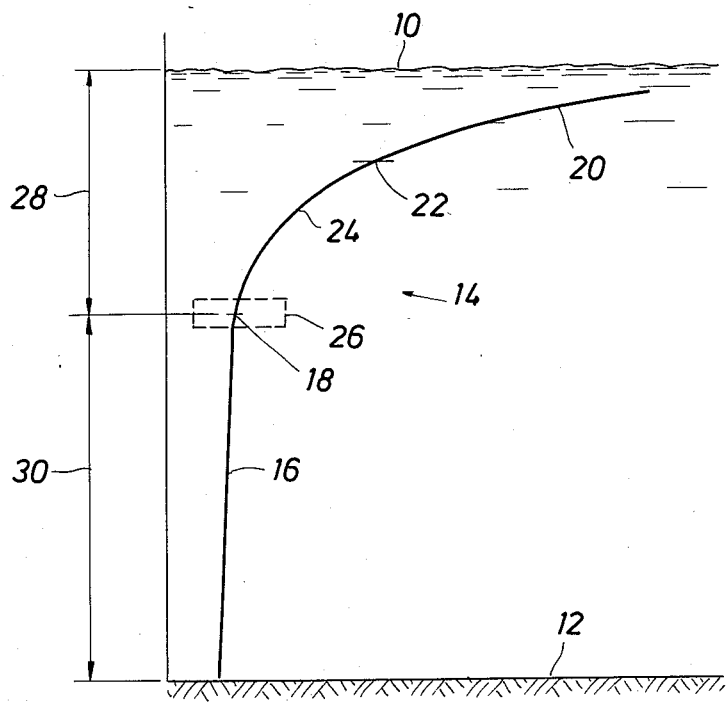
FIG. 1
FIG. 3
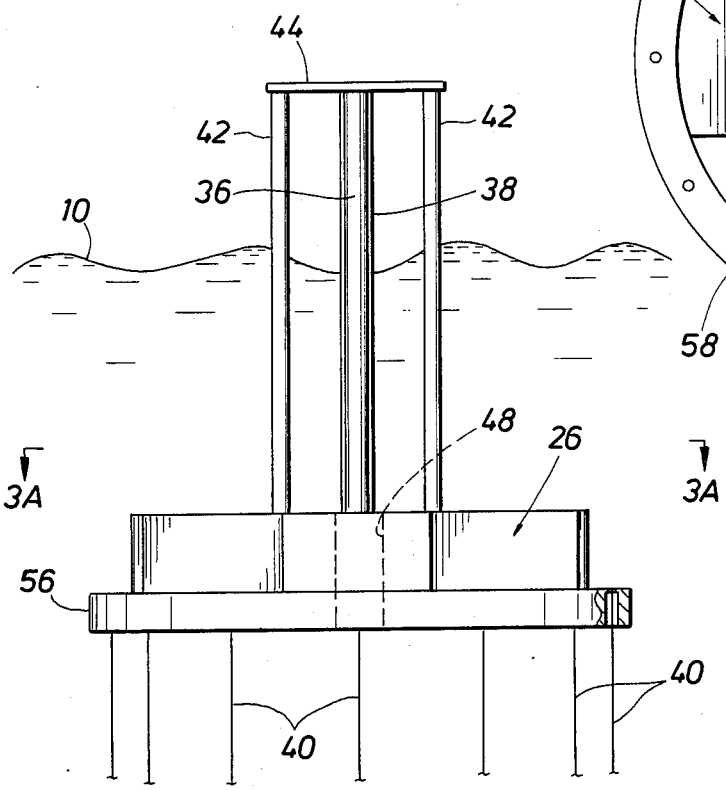
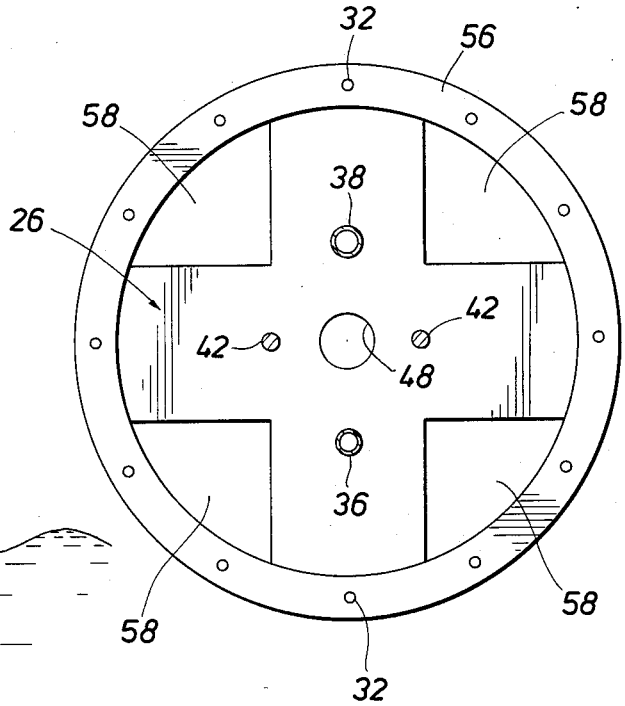
FIG. 3A

FIG. 2
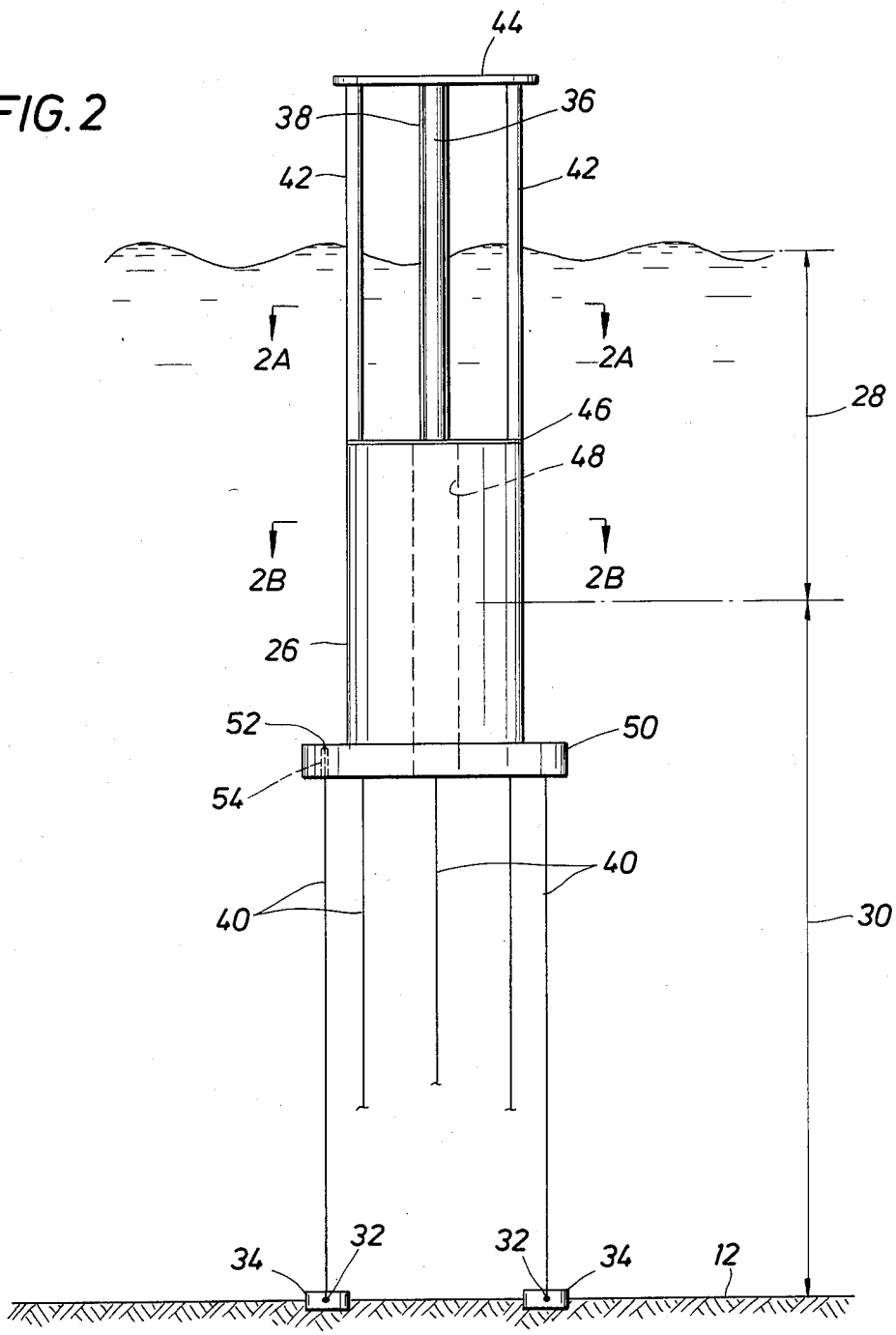
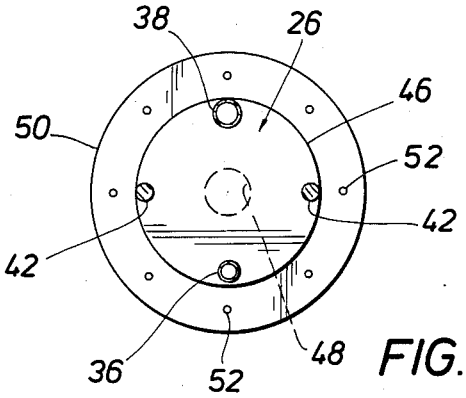
FIG. 2A
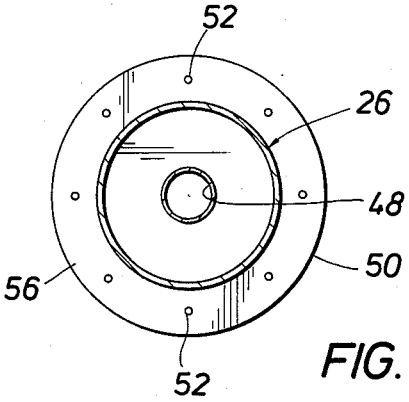
FIG. 2B

SUBMERGED MULTI-PURPOSE FACILITY

BACKGROUND OF THE INVENTION

1. Field of the Invention

This invention pertains to submerged multi-purpose facilities, such as a manned submersible drilling and production structure used in offshore oil and gas production.

2. Description of the Prior Art

An examination of marine structures useful in providing a working facility for industrial application reveals that such structures have been designed in the past to withstand or protect against the natural marine forces acting upon the structure. For example, offshore drilling platforms designed to provide a working facility above the surface of the water must be designed to overcome the tremendous lateral forces of wave action and currents that constantly lash at the superstructure. In addition, the support legs have to be sufficiently ruggedly built so that they can withstand the enormous hydrostatic pressures that are present all of the way to the bottom of the sea.

Improvements on such a basic theme have included breakwaters to reduce the lateral forces before they hit against the superstructure and semi-submersible structures which cause at least some of the structures to escape some of the heaviest forces on the surface.

Drilling ships have also been used. Such ships have to be anchored or constantly dynamically corrected to maintain the ship in a relatively constant position. The anchoring or mooring lines are generally exposed to the same large lateral forces discussed above. In addition, the use of such lines have to include a means for adjusting the lengths as the ship rises and falls. Dynamic repositioning using orthogonally driven propellers means that such a system is always exposed to the possibility that a motor will stop. Moreover, a ship which is buoyant on or just below the surface must include means for vertically adjusting the length of the risers and other appendages attached to the structure and to the sea bottom.

Many attempts are shown in the prior art for at least partially avoiding the surface and near-surface lateral forces by using a submersible or partly submersible structure. For example, U.S. Pat. No. 3,455,115, Burrus, reveals a submersible chamber which is tethered to the bottom via a float-pulley combination that permits its precise location or positioning. The structure is operably positionable through such a technique between a location near the bottom to above the surface. Normally, the location of the chamber is near the bottom. The float-pulley combination provides means for raising the chamber for maintenance purposes.

U.S. Pat. No. 3,638,720, Thomas, discloses a submerged capsule for servicing many wells at a intermediate production zone. The use of cables for tie-down purposes is recognized, but the location of the structure is not optimized. U.S. Pat. No. 3,656,307, Mott, reveals a sub-sea installation connected to the bottom of the sea. A buoyant mast extends upwards therefrom to assume a desirable location, which is below the surface, with rigid conduits projecting above the water surface. No optimal location is suggested for the buoyant mast.

U.S. Pat. No. 3,766,874, Helm, et al., shows a two-section barge, one section being below the water line and one section being above. The joinder of the two sections is by a line below the water surface. The structure shown in U.S. Pat. No. 3,771,484, Schott, et al., is an inflatable island suitable for providing a landing strip. There is a submerged portion of the structure; however, it is not optimized in location other than to keep the island suitably above the surface of the water.

The structure shown in U.S. Pat. No. 3,902,533, Jergins, is a submersible rig. The rig is secured to the bottom, not at an intermediate level between the bottom and the surface. Jergins did recognize that at lower depths, the rig must withstand enormous inward pressures, but no solution is given.

U.S. Pat. No. 4,473,323, Gregory, discloses a buoyant substructure underneath the surface of the water, with a drilling platform above the sea surface. The location of the overall structure is in the area for carrying the brunt of lateral surface wave action. The structure shown in U.S. Pat. No. 4,004,531, Mott, is similar to the elements of the structure shown in Gregory patent '323. In addition, a protective caisson is inclined to protect the riser pipe from the submerged structure to the drilling deck. Nothing is optimized with respect to vertical location.

U.S. Pat. No. 4,212,561, Wipkink, shows two vertically spaced separate structures, at least one of which is submerged. The structures are connected together with relative movement in mind. The connections include ducts for fluid and the like, but the location of the submerged structure is not optimized.

In contrast to the approach taken in the prior art of withstanding the environment, the Submerged Multi-Purpose Facility disclosed herein is a structure which provides a working marine environment which takes advantage of the natural forces in its design and installation.

Therefore, it is a feature of the present invention to provide a submerged multi-purpose facility which is located at an improved optimal depth location regarding the natural lateral forces existing in the marine location where the facility is positioned for operations.

It is another feature of the present invention to provide an improved submerged multi-purpose facility which is located optimally with regard both lateral forces and hydrostatic pressure forces.

It is still another feature of the present invention to provide an improved submerged multi-purpose facility which does not require an extremely rugged support structure, but satisfactorily employs anchored tethers and a balanced buoyant/ballast to keep the facility in location.

SUMMARY OF THE INVENTION

The invention pertains to optimizing the location of a buoyant, submersible enclosed facility by ballasting the facility for a location below the surface of water at a position in or just below the knee range of the exponential curve of lateral forces. Since the vertical stability of the facility is dependent on its buoyancy/ballasting characteristics, only the lateral drift is of concern. Drift is kept within close limits through tethering the facility to the sea bottom using one or more cables or other slightly flexible tie-down means. Since the lateral forces are much reduced at such a location compared with the surface lateral forces and near-surface lateral forces, heavy and expensive support structures used in prior art surface and semi-submersible platforms are avoided. The location is optimized also with respect to hydrostatic forces. The bottom locations that have been felt desirable by some in the past are also avoided. This is because the facility is located sufficiently far from the bottom where the walls of the facility are required to be only strong enough to resist the existing hydrostatic forces at the location.

An elevator and stairwell shaft extends from the structure to a level above the surface of the water for ready access. In the preferred embodiment, this access would be at atmospheric pressure.

The tie-down means also provides ready disconnect for moving the structure to a new location.

BRIEF DESCRIPTION OF THE DRAWINGS

So that the manner in which the above-recited features, advantages and objects of the invention, as well as others which will become apparent, are attained and can be understood in detail, a more particular description of the invention briefly summarized above may be had by reference to the embodiment thereof which is illustrated in the appended drawings, which drawings form a part of this specification. It is to be noted, however, that the appended drawings illustrate only a preferred embodiment of the invention and are therefore not to be considered limiting of its scope as the invention may admit to other equally effective embodiments.

In the Drawings

FIG. 1 is a graphical representation of a lateral force curve useful in determining the optimal location for the Submerged Multi-Purpose Facility (SMF) in accordance with the present invention.

FIG. 2 is a schematic elevation view of a Submerged Multi-Purpose Facility in accordance with the present invention.

FIG. 2A is a horizontal sectional view of the ingress and egress structure.

FIG. 2B is a horizontal sectional view of the Submerged Multi-Purpose Facility.

FIG. 3 is a schematic elevation view of an alternate embodiment of the Submerged Multi-Purpose Facility.

FIG. 3A is a horizontal sectional view of the alternate embodiment of the Submerged Multi-Purpose Facility.

DESCRIPTION OF THE PREFERRED EMBODIMENT

Now referring to the drawings and first to FIG. 1, a graphical representation of the ambient lateral forces which are present in a body of water is illustrated. The body of water is located between mean surface 10 and bottom 12. The lateral forces of the water are present because of tide movement and prevailing currents. Although there are variations in such movements from season to season and even over a shorter period of time, the average values of such ambient lateral forces are sufficiently determinable that a force curve 14 can be plotted.

The vertical axis of the curve is the depth of the water and the horizontal axis of the curve represents the existing lateral forces which have just been described. It can be shown that the lateral force curve generally describes an exponential curve. That is, near bottom 12 the lateral forces are quite small and although they are somewhat greater away from the bottom, there is a low-force range 16 of the curve which exists up to a point 18. There is also a high-force range 20 of the curve that exists above point 22. That is, the curve flattens out asymptotically above this point. The high-force range portion of the curve is near the surface and beneath, but near the surface. There is also a mid-range of the curve between points 18 and 22 which can conveniently be referred to as "knee range" 24. This is the portion of the curve which is most curvilinear and which is generally located between the substantially linear portion 16 and 20.

In determining the curve for a given geographical location, lateral force calculations are made at a plurality of depths so that the curve 14 can be plotted. Once the curve has been created, the location for the multi-purpose facility is ideally within knee range 24 or slightly below such range. Locating facility 26 at the low side of this range in the vicinity of point 18 is felt to be the optimal position. Hence, it has been determined by the above procedure that facility 26 should located at a depth 28 from mean surface level 10, or, alternatively at a height 30 from bottom 12. Since the surface varies and the bottom does not, reference is usually at the bottom.

Now referring to FIG. 2, a schematic elevation of a Submerged Multi-Purpose Facility 26 is illustrated as it might appear at a specific geographic location. The location of the facility is at a depth 28 with respect to surface 10 or at an elevation 30 with respect to bottom 12. A somewhat flexible tether 40 depends vertically from facility 26 and is connected by a disconnect junction 32 to an anchor 34 located on bottom 12. One or more tethers 40 are anchored so that facility 26 can move slightly in the lateral direction but without appreciable vertical movement. Tether 40 is connected to facility 26 by extending through tie down port 54 in ballasting means 50 and connecting to tie points 52 on the upper surface of the ballasting means.

Elevator shaft 36, stairwell shaft 38 and air shaft 42 extend from the facility to access platform 44 above mean surface 10. FIG. 2A shows a horizontal cross-section of the elevator shaft, stairwell shaft and air shaft looking down toward the facility rim 46. The preferred embodiment is at atmospheric pressure, although a pressurized facility can also be provided.

FIG. 2B shows facility 26 in horizontal cross-section. The facility is designed with a hollow core 48 to permit the facility to encircle lines and tubing which would communicate with the floor 12 and/or access platform 44. Ballasting means 50 in the preferred embodiment encircles the bottom of facility 26 like a doughnut, providing ledge 56 through which and to which the tethers may be affixed. Ports 54 are provided for that purpose.

The internal structure of the facility is determined by the use of the facility. Ordinarily, one or more equipment chambers would be included and additional chambers or compartments would be provided for housing the personnel while working and for providing lodging and office facilities.

Although the facility has been described with respect to a vertically tall and horizontally comparably smaller dimension, the specific configuration is dictated by the purpose of the facility, not by the optimal location in accordance with the above discussion. A horizontally large, vertically smaller doughnut-shaped facility might be the most desirable configuration for the Submerged Multi-Purpose Facility in many circumstances. The invention is not limited to a particular shape of facility.

FIGS. 3 and 3A illustrate such an alternate embodiment of the facility. As horizontal cross-section of Submerged Multi-Purpose Facility 26 shows in FIG. 3A, a doughnut-shaped facility would provide open space 58 within the doughnut configuration itself.

Although discussed in terms of a drilling and production facility, it is apparent that the facility which has just been described may be provided for other purposes. For example, a facility can be provided in like manner for observation of marine life.

The facility which is located utilizing the technique described in connection with FIG. 1 might seem to dictate that facility 26 could be located within range 16 as well as at the location which is shown at point 18. However, the hydrostatic pressure which exists with the lower depths along line 16 would dictate against such a location. That is, a facility located within range 16 would have to be stronger than it would have to be if located at point 18 or above due to the difference in hydrostatic pressure at these different locations. Therefore, once the lateral force curve has been determined, the design of the facility should be with respect to locating the facility at point 18 and not at a deeper location. In summary, although the lateral forces may be slightly smaller at a deeper location, the hydrostatic forces are sufficiently great at a deeper location that the optimal location considering both the lateral forces and the hydrostatic forces dictates that the ideal location is at point 18.

Should an emergency arise, or just for the convenience of revising the facility or relocating, the tethers are readily and quickly disconnectable, a convenience not present with prior art installations having massive supports and related structure.

It is mentioned that the vertical positioning of the facility will be determined using buoyancy and ballasting (anti-buoyancy) means to locate the facility at a depth 28 from the surface and at a vertical distance 30 from the bottom. Location 30 with respect to the bottom is the preferred steady-state location to maintain since this distance does not change, but the mean level of the surface is subject to change.

Therefore, while several embodiments of the invention have been generally described, it will be understood that the invention is not limited thereto. Many modifications may be made and will become apparent to those skilled in the art.

What is claimed is:

1. A method for establishing the location of a Submerged Multi-Purpose Facility beneath the surface of a body of water for affording a support structure capable of withstanding high lateral forces at and near the water surface, which comprises:

determining at the geographical location where the facility is to be located the magnitude of existing lateral forces at a representive plurality of depth locations, plotting said magnitudes and determining a substantially exponential curve wherein the lateral forces at or near the surface define a relatively linear high-force range and the lateral forces near the bottom of the water define a relatively linear low-force range, the generally curvilinear part of the curve between said high-force range and said low-force range defining the knee range of the curve, positioning said facility using buoyancy means and ballasting means at a depth location within or below the knee range of the curve, and anchoring the facility to the bottom in such a manner so as to permit a small amount of lateral movement by the small lateral forces prevailing at the positioned depth location for the facility.

2. The method in accordance with claim 1, and including determining the magnitude of the hydrostatic pressure forces at a representative plurality of depth locations in the top of the low-force range and in the knee range, calculating the total magnitude of the lateral forces and hydrostatic pressure forces for a representative plurality of depth locations to determine the optimal position where the total magnitude of said forces is the least, and positioning said facility at said optimal position.

3. Submerged Multi-Purpose Facility apparatus positioned beneath the surface of a body of water having a known exponential lateral force curve for depths below its surface, lateral forces at and near the surface defining a relatively linear high-force range and lateral forces near the bottom defining a relatively linear low-force range, there being a defined knee range of the curve therebetween, comprising a watertight compartmentalized facility suitable for housing equipment and personnel, said facility being sufficiently buoyant for causing an upward force for locating said facility above said exponential knee range, ballasting means attached to said facility for adjustably opposing the upward force for locating the facility at a predetermined depth position at or below the knee range of the curve, and slightly flexible bottom anchor means being sufficiently flexible to permit a small amount of lateral movement by the small lateral forces prevailing at the facility depth position without substantial vertical movement.

4. Submerged Multi-Purpose Facility apparatus in accordance with claim 3, wherein said facility includes environmentally protected access means leading to above the water surface to permit entry to said facility from the surface.

5. Submerged Multi-Purpose Facility aparatus in accordance with claim 4, wherin said environmentally protected access means includes a shaft protruding above the surface of the water.

6. Submerged Multi-Purpose Facility apparatus in accordance with claim 4, wherein said environmentally protected access means provides access to said facility at atmospheric conditions.

7. Submerged Multi-Purpose Facility apparatus in accordance with claim 3, wherein said anchor means includes disconnect means for attaching to the bottom, said disconnect means permitting said facility to be released for relocation and bottom connection at the relocation site.

* * * * *